US007191887B2

(12) United States Patent
Schrumpf

(10) Patent No.: US 7,191,887 B2
(45) Date of Patent: Mar. 20, 2007

(54) LOCKING SECURITY COVER FOR CURRENCY VALIDATOR AND DEPOSITORY CASSETTE

(76) Inventor: Louis Schrumpf, 1618 Waters Edge Dr., Toms River, NJ (US) 08753

( * ) Notice: Subject to any disclaimer, the term of this patent is extended or adjusted under 35 U.S.C. 154(b) by 0 days.

(21) Appl. No.: 11/207,689

(22) Filed: Aug. 22, 2005

(65) Prior Publication Data

US 2006/0037837 A1 Feb. 23, 2006

Related U.S. Application Data

(60) Provisional application No. 60/603,289, filed on Aug. 23, 2004.

(51) Int. Cl.

| | |
|---|---|
| ***G07F 9/10*** | (2006.01) |
| ***B65D 55/02*** | (2006.01) |
| ***B65D 55/16*** | (2006.01) |
| ***B65D 50/00*** | (2006.01) |

(52) U.S. Cl. ..... 194/350; 70/158; 70/164

(58) Field of Classification Search ..... 194/350, 194/202; 70/2, 57, 77, 78, 158, 163, 164, 70/166, 167, 443

See application file for complete search history.

(56) References Cited

U.S. PATENT DOCUMENTS

| | | | | |
|---|---|---|---|---|
| 5,730,271 | A * | 3/1998 | Buchman et al. | 194/206 |
| 5,836,510 | A * | 11/1998 | Kirchner | 232/15 |
| 6,698,569 | B2 * | 3/2004 | Kaehler | 194/350 |

* cited by examiner

*Primary Examiner*—Patrick Mackey
*Assistant Examiner*—Mark J. Beauchaine
(74) *Attorney, Agent, or Firm*—Clifford G. Frayne

(57) ABSTRACT

A locking security cover which provides means for locking a depository cassette or receptacle to the currency validator mechanism limiting unauthorized access to the collected currency in the depository cassette, the locking security cover nests the depository cassette to the currency validator by means of key holes located on either side of the cover, cooperable with corresponding studs associated with the validator, thereby securing the locking security cover in a downward position and locked in position by a shackle secured to the rear face of the depository cassette cooperative with a downwardly extending back face of the locking security cover for receipt of a padlock, thereby securing the locking security cover.

3 Claims, 8 Drawing Sheets

LOCKING SECURITY COVER FOR CURRENCY VALIDATOR AND DEPOSITORY CASSETTE

RELATED APPLICATIONS

Applicant claims the benefit of provisional application 60/603,289 filed Aug. 23, 2004.

BACKGROUND OF THE INVENTION

1. Field of the Invention

The present invention relates to currency validators and depository cassettes widely used in vending and gaming machines to validate paper currency or bills inserted therein and thereafter stored in a depository cassette or receptacle, and more particularly, to a locking security cover which prevents unauthorized access to the depository cassette or receptacle.

2. Description of the Prior Art

Currency validators and depository cassettes are in widespread use, particularly with respect to vending and gaming machines wherein the currency validator is mounted to the interior frame of the vending machine and has the depository cassette or receptacle fitted to its rear face. Money in the forms of paper currency or bills are inserted into the currency slot on the face of the vending or gaming machine and drawn into the currency validator by a series of gears and conveyer belts whereby the paper currency or bill is positioned in a validation mode and validated by the interior electronics of the validator. Once validated, the paper currency or bill is deposited by means of an actuator arm into the depository receptacle or cassette. Applicant's invention does not address or have application to the interior functions and structure of the validating of the currency validator or depository cassette, but for a reference to same one can utilize the disclosure of U.S. Pat. No. 5,405,131 for a typical interior mechanism for operation. The currency validator and depository cassette obtain their power from the power provided to the vending machine itself.

The currency validator and depository cassette are normally two pieces which are separable by a number of different means. The cassette is removable to allow access to the monies collected within the cassette from the use of the vending machine. In some instances the depository cassette or receptacle merely snap fits back into position with the currency validator and in other embodiments, with no means to secure the depository cassette or receptacle to the currency validator have been made.

The depository receptacle or cassette varies in size, but the two most popular and main type of depository cassettes are dimensioned to hold either three hundred separate bills or paper currency or six hundred separate bills or paper currency. Access to the monies in the depository receptacle or cassette is accomplished by one of three means. In the smaller size cassettes or receptacles of the type holding up to three hundred bills, access is made by either the snap fit top opening to allow withdrawal of the bills or the bills may be withdrawn from the front of the cassette which is open and in communication with the currency validator when assembled and in operation as the bills are fed through this opening into the cassette. This opening in the cassette becomes accessible when the cassette is removed from the currency validator.

In the larger type depository, cassettes or receptacles of the six hundred bill type, a third means of ingress is also used. This means of ingress are two doors on the lateral sides of the cassette which are pivotally mounted and can be swung open to allow access to the bills from the lateral sides.

Some of the currency validator and depository cassettes attempt to incorporate security devices to prevent unauthorized access to the depository cassettes. Unauthorized access could come from the use of an unauthorized key or vandalism which would allow an individual to remove the depository cassette and remove the monies contained therein. In actual operation, the individual responsible for maintaining the vending machine is the only individual who should have access to the depository cassette.

Applicant's invention relates to a locking security cover which can be utilized with all types of currency validators and depository cassettes of both the three hundred bill and six hundred bill size which can be secured to the assembly and insure that an unauthorized person cannot remove the depository cassette or receptacle without having the proper key. Applicant's locking security cover can be applied to all of the currency validator and depository receptacles currently in use with minor modification to the existing currency validator and depository cassette assemblies.

OBJECTS OF THE INVENTION

An object of the invention is to provide for a locking security cover for a currency validator and depository cassette assembly which prevents unauthorized removal and access to the depository cassette.

A further object of the present invention is to provide for a security locking cover for a currency validator and depository cassette which security locking cover secures depository cassettes of varying sizes.

A further object of the present invention is to provide for a security locking cover for a currency validator and depository cassette in which all possible means of ingress into the depository cassette are secured by a single locking cover.

A still further object of the present invention is to provide for a secure locking cover for a currency validator and depository cassette which can be incorporated without any major modifications to existing currency validators and depository cassettes.

SUMMARY OF THE INVENTION

A locking security cover which provides means for locking a depository cassette or receptacle to the currency validator mechanism limiting unauthorized access to the collected currency in the depository cassette, the locking security cover nests the depository cassette to the currency validator by means of key holes located on either side of the cover, cooperable with corresponding studs associated with the validator, thereby securing the locking security cover in a downward position and locked in position by a shackle secured to the rear face of the depository cassette cooperative with a downwardly extending back face of the locking security cover for receipt of a padlock, thereby securing the locking security cover.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
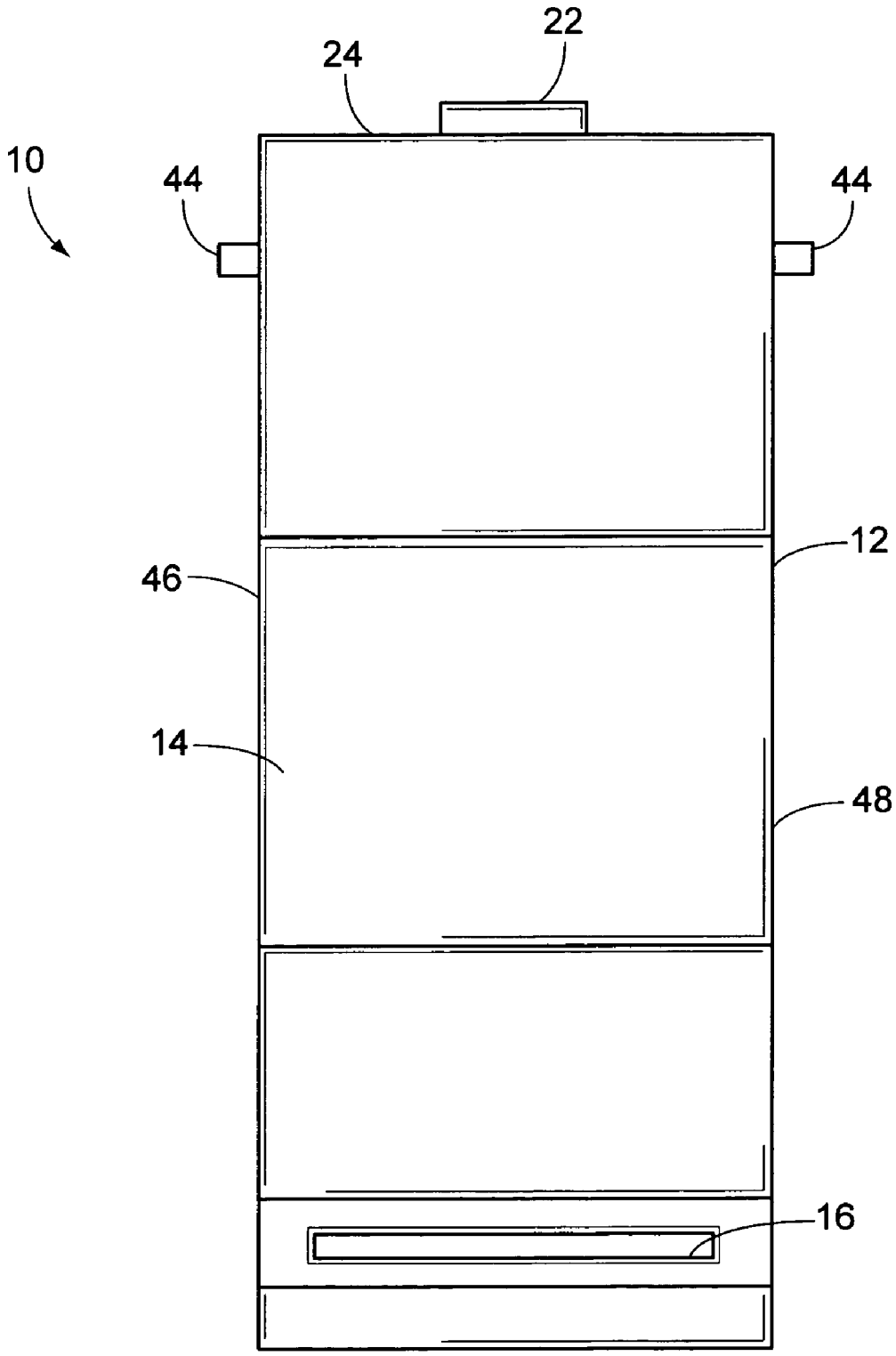
FIG. 1 is a front view of the currency validator.
Figure 2:
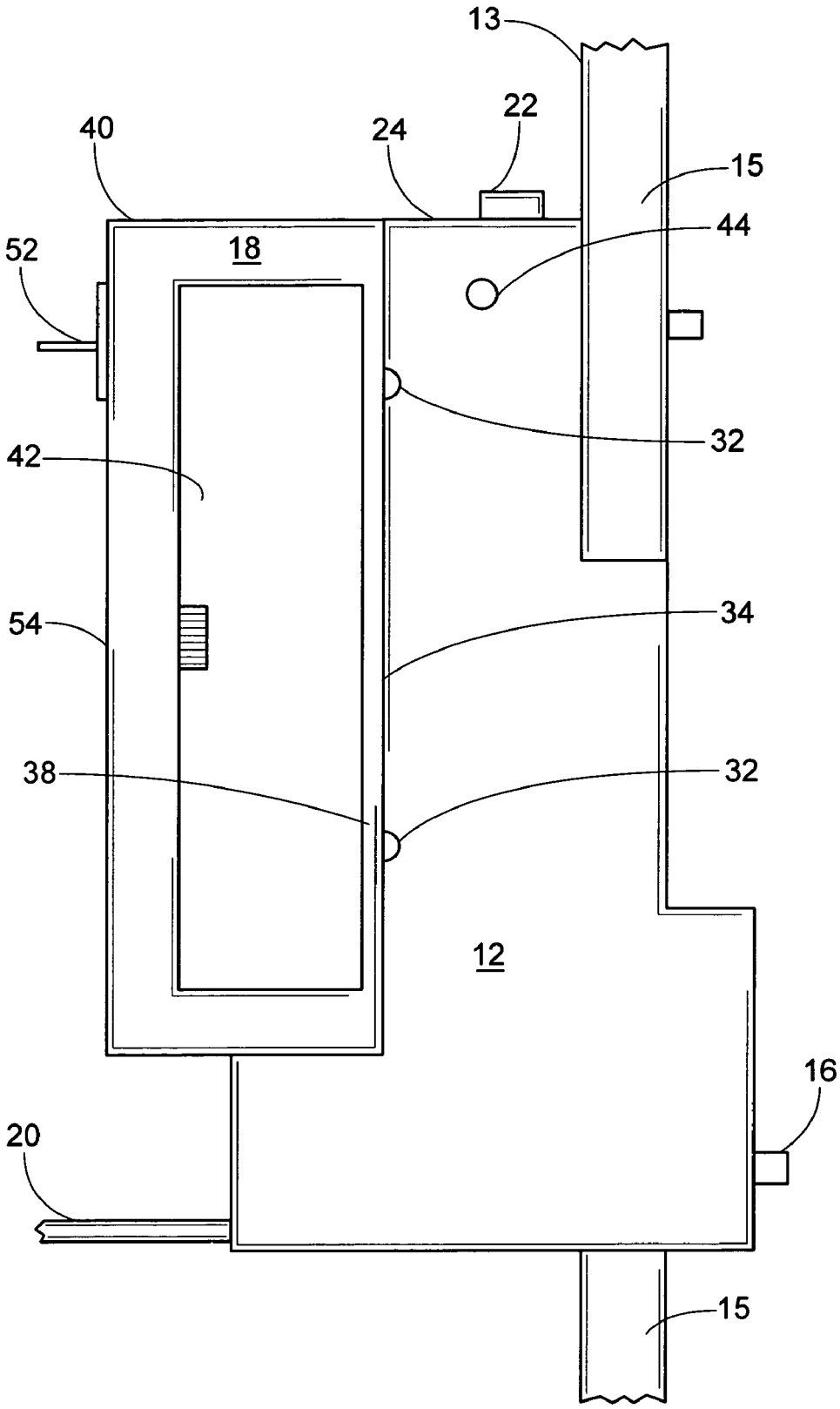
FIG. 2 is a side view of the currency validator and depository cassette in a mated orientation.
Figure 3:
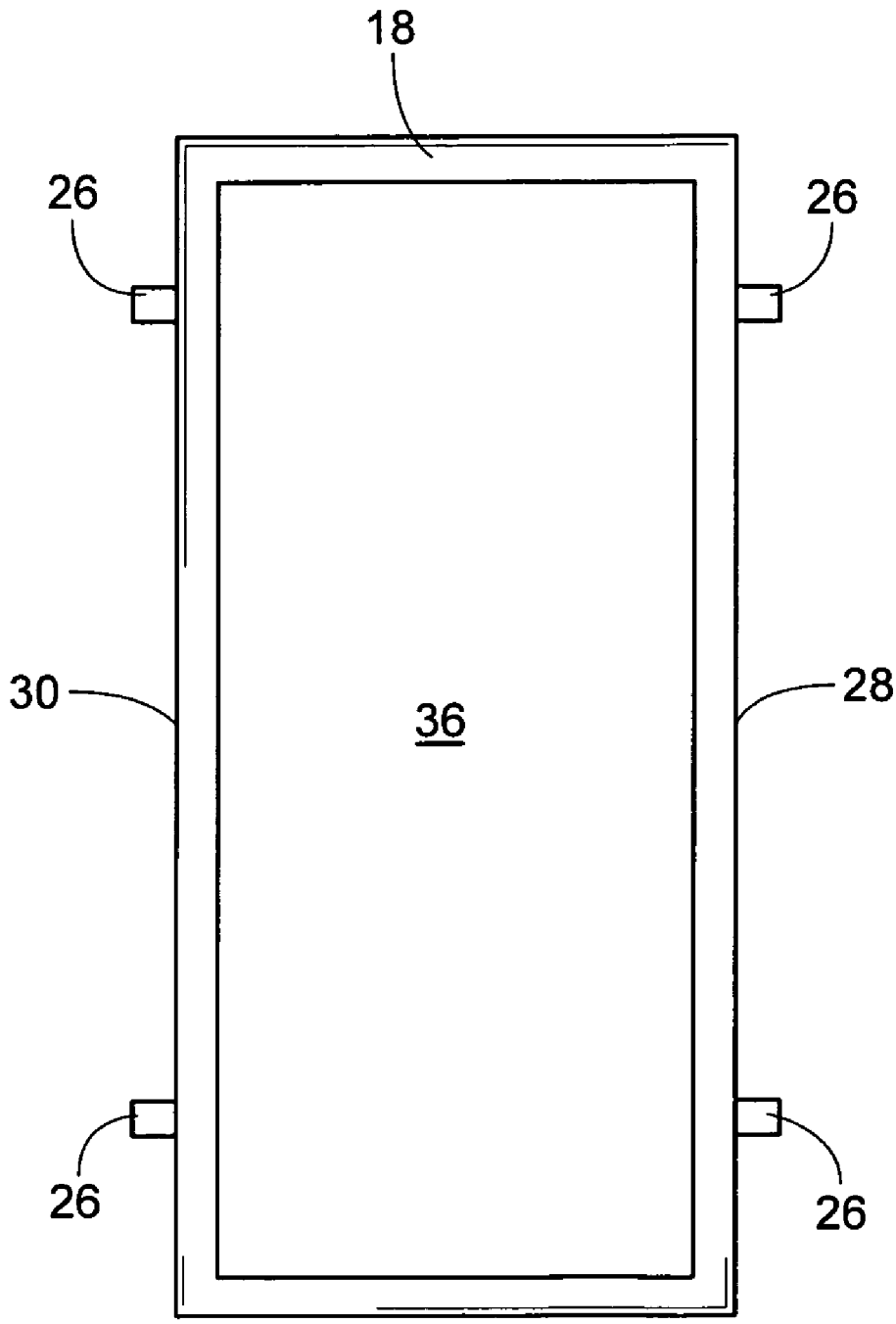
FIG. 3 is a front view of the depository cassette.

FIG. 1 is a front view of the currency validator and depository cassette 10 and FIG. 2 is a side view of the currency validator and depository cassette 10 in mated orientation and FIG. 3 is a front view of the depository cassette 18 disengaged from the currency validator 12. The currency validator 12 consists of a housing 14 in which the transport means and the validation means is housed. The housing 14 is mounted to the rear face 13 of the front of the vending machine 15 such that the currency slot 16 is accessible to a user when the vending machine is closed. Typically, the user must orient the bill or currency in the correct orientation and feed it into the currency slot 16 where the transport means engages the edge of the bill and transports the bill to a validation point. When the bill is in registration at the validation point, the bill is validated. The user then has the option of choosing or selecting an item from the vending machine. The bill by means of an internal actuation arm will then be inserted into the depository cassette 18.

FIG. 2 illustrates the depository cassette 18 in mated orientation with the currency validator 12. The power for the currency validator is by means of a power cord 20 in communication with the power source for the vending machine.

In normal operation the depository cassette 18 is removable from the currency validator 12 by pressing a release button 22 located on the top 24 of the currency validator 12 which releases an internal catch. The depository cassette 18 is then slid upwardly on internal guides in engagement with the currency validator 12 until four finger-like protrusions 26 on the lateral sides 28 and 30 of the depository cassette 18 are in alignment with four cutouts 32 on the rear face 34 of the currency validator 12. The currency validator 12 and the depository cassette 18 can then be separated by pulling the depository cassette 18 rearwardly disengaging it from the currency validator 12.

FIG. 3 is a front view of the depository cassette 18 illustrating its lateral side walls 28 and 30 and the four finger-like protrusions 26 which must be aligned with the cutouts 32 on the currency validator 12 in order to remove the depository cassette 18. Enclosed within the depository cassette 18 housing is a biased depressable plate 36 which when empty is positioned approximate the front face 38 of the depository cassette 18. As bills are transferred from registration in the currency validator 12 into the depository cassette 18, the depressable plate 36 is depressed against a biasing means until the depository cassette 18 has accumulated the maximum number of bills which it is designed to hold.

Access to the bills is in one of three manners. If the depository cassette 18 has been removed from the currency validator 12, authorized personnel can remove the accumulated bills from the front face 38 of the depository cassette 18. Alternatively, the depository cassette 18 is formed with a snap lock pivotal upper cover member 40 which frictionally engages the depository housing. By the use of one's thumb the upper cover member 40 can be pivotally opened and access to the accumulated currency can be had from the top of the depository cassette 18.

A third alternative means of access utilized primarily on the larger depository cassettes accumulating six hundred bills is a pair of pivot doors 42 formed on the lateral sides 28 and 30 of the depository cassette 18. These doors 42 again snap fit to the depository cassette 18 housing and are pivotally mounted such that they can be disengaged from their frictional seal and access to the accumulated bills can be had through the lateral side walls 28 and 30 of the depository cassette 18.

As long as the vending machine is secure and not subject to vandalism and as long as the proper authorized individual is the only individual who has access to the interior of the vending machine, the system works as intended. However, if the machine is subject to possible vandalism or if a person other than authorized personnel can gain access to the interior of the vending machine, the depository cassette 18 can be easily accessible and the accumulated monies removed. There is therefore a need to be able to secure the depository cassette 18 to the currency validator 12 and to prevent the opening of the pivotal upper member 40 of the depository cassette 18 or the lateral side doors 42 of the depository cassette 18 even if the depository cassette 18 remains secured to the currency validator 12. Applicant's locking security cover accomplishes the securing of all three means of ingress with little modification to the assembly.

Referring to FIGS. 1 and 2, the only modification to the currency validator 12 as an original piece of equipment manufacture would be the placement of a pair of outwardly depending studs 44 on opposing lateral sides 46 and 48 of the currency validator 12 proximate its top surface 24, the pair of studs 44 being rigidly secured to the currency validator 12 by any suitable means. The only modification to the depository cassette 18 as an original piece of equipment manufacture would be the securing of a shackle member 52 on the rear face 54 of the depository cassette 18. The shackle member 52 being for receipt of a locking means in the form of a padlock or the like.

Figure 4:
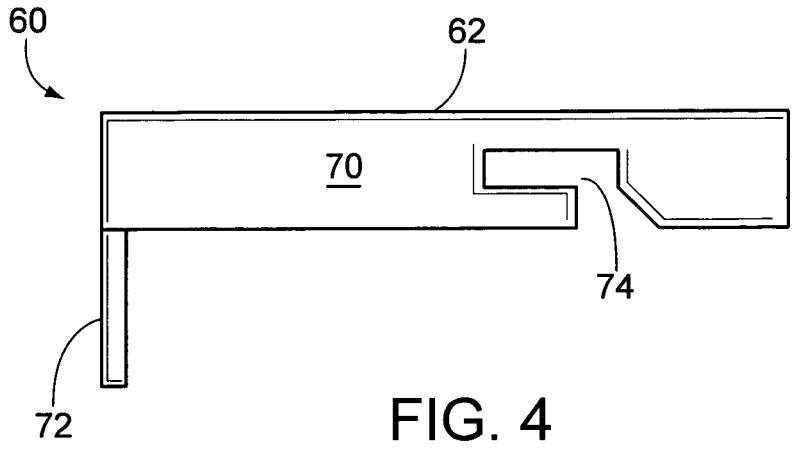
FIG. 4 is a side view of the locking security cover.
Figure 5:
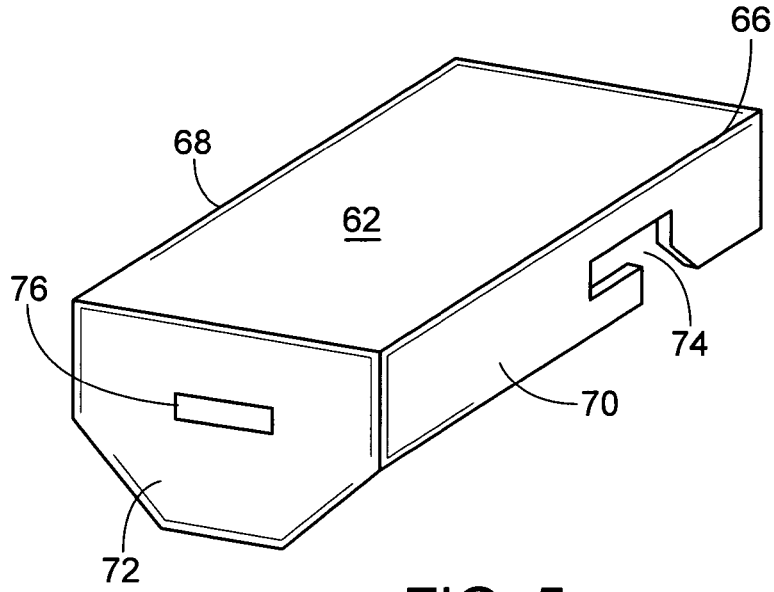
FIG. 5 is a perspective view of the locking security cover.
Figure 6:
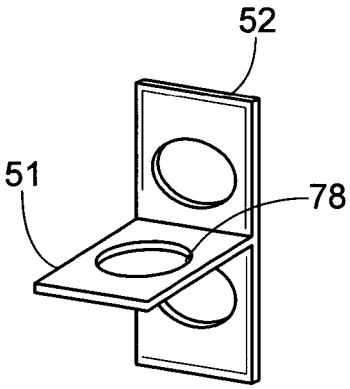
FIG. 6 is a perspective view of the shackle.

Referring now to FIGS. 4, 5, and 6, there is illustrates the Applicant's locking security cover 60 and shackle 52. Applicant's locking security cover 60 would be of one piece construction made of stamped metal or other suitable material. The security locking cover 60 would have a top surface 62 the width and length thereof would approximate the top surfaces of the currency validator 12 and depository cassette 18 when in mated orientation. The lateral edges 64 and 66 of the top surface 62 would be formed at 90 degree perpendicular angles to form opposing side surfaces 68 and 70 of the security locking cover 60 and one end of the top surface 62 would be formed at a 90 degree angle to form an end wall 72, the side surfaces 68 and 70 and the end wall 72 depending from the same side of the top surface 62 of the locking security cover 60. L-shaped keyholes 74 are formed in the lateral side surfaces 68 and 70 of the locking security cover 60, the dimensions of the L-shaped keyholes 74 approximating the diameter of the studs 44 positioned on the currency validator 12. The depending end wall 72 of the locking security cover 60 would have a slot 76 formed therein, said slot cooperable with the outwardly depending portion 51 of shackle member 52 positioned on the rear face 54 of the depository cassette 18.

In this manner, when the currency validator 12 and the depository cassette 18 are in mated orientation, the locking security cover 60 is positioned on top of the upper surface of the currency validator 12 and depository cassette 18. The end wall 72 of the locking cover 60 depends along the rear face of the depository cassette 18. The studs 44 are brought into registration with L-shaped keyholes 74 and locking security cover 60 is pressed downwardly over studs 44 and then pushed forwardly such that the studs 44 are further engaged in the L-shaped keyhole 74 such that the locking security cover 60 can be pressed no further forward and the end wall 72 of the locking security cover 60 has engaged the rear face 54 of the depository cassette 18 with the outwardly depending portion 51 of shackle member 52 extending through slot 76 formed in the end wall of the locking security cover 60. A securing means in the form of a padlock or lock 80 can then be passed through the aperture 78 on outwardly depending portion 51 of the shackle member 52 and secured.

Figure 7:
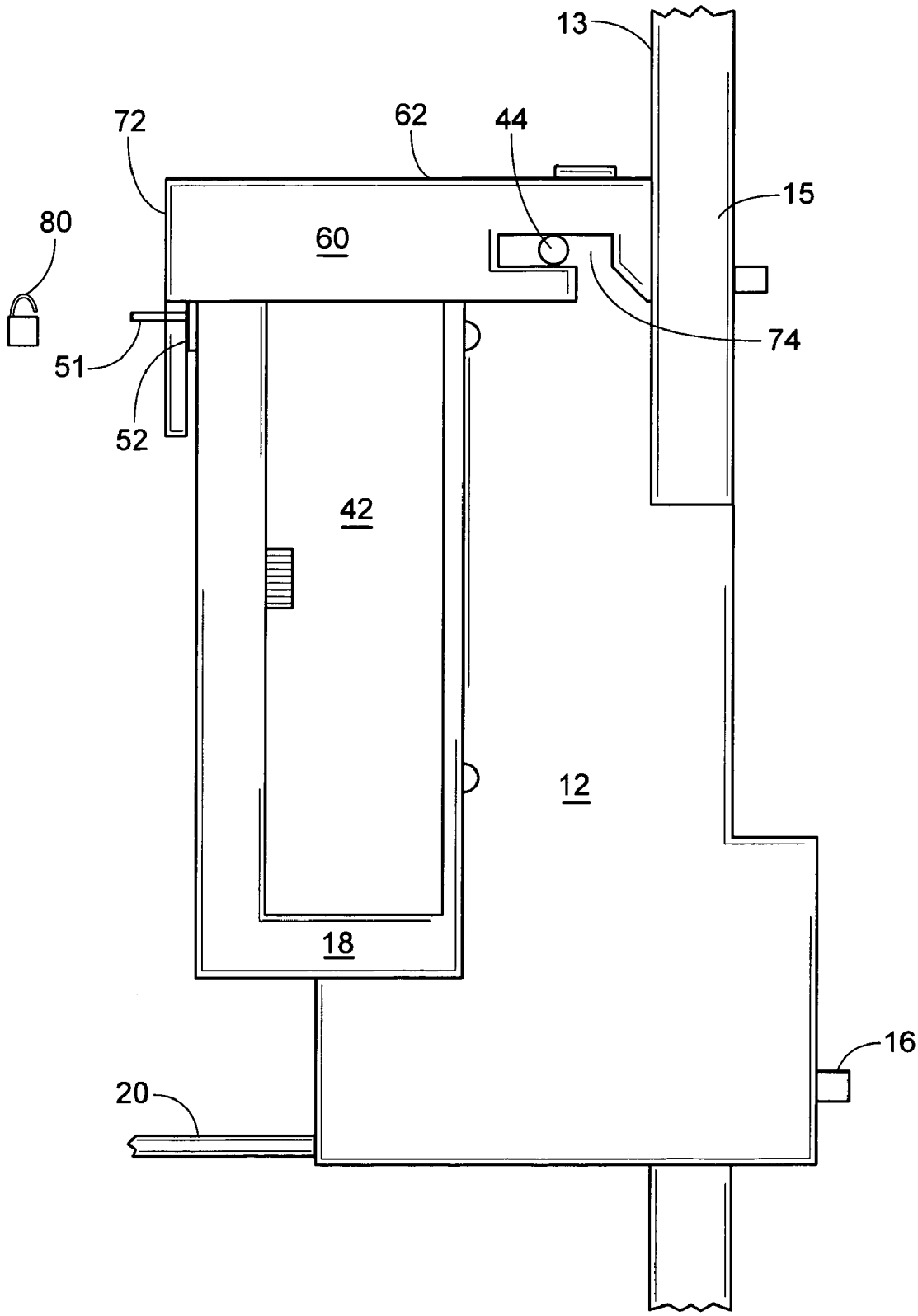
FIG. 7 is a side view of the locking security cover in situ with a currency validator and mated depository cassette.

In this configuration (see FIG. 7), the depository cassette 18 cannot be removed from the currency validator 12 unless the locking security cover 60 is removed. Still further, access to the upper cover member 40 of the depository cassette 18 is denied by the locking security cover 60. Still further, the lateral side surfaces 68 and 70 of the locking security cover 60 depend a sufficient length such that the pivotal access doors 42 in the lateral sides of the depository cassette 18 cannot be pivoted to an open position to allow access to the monies accumulated therein.

Figure 8:
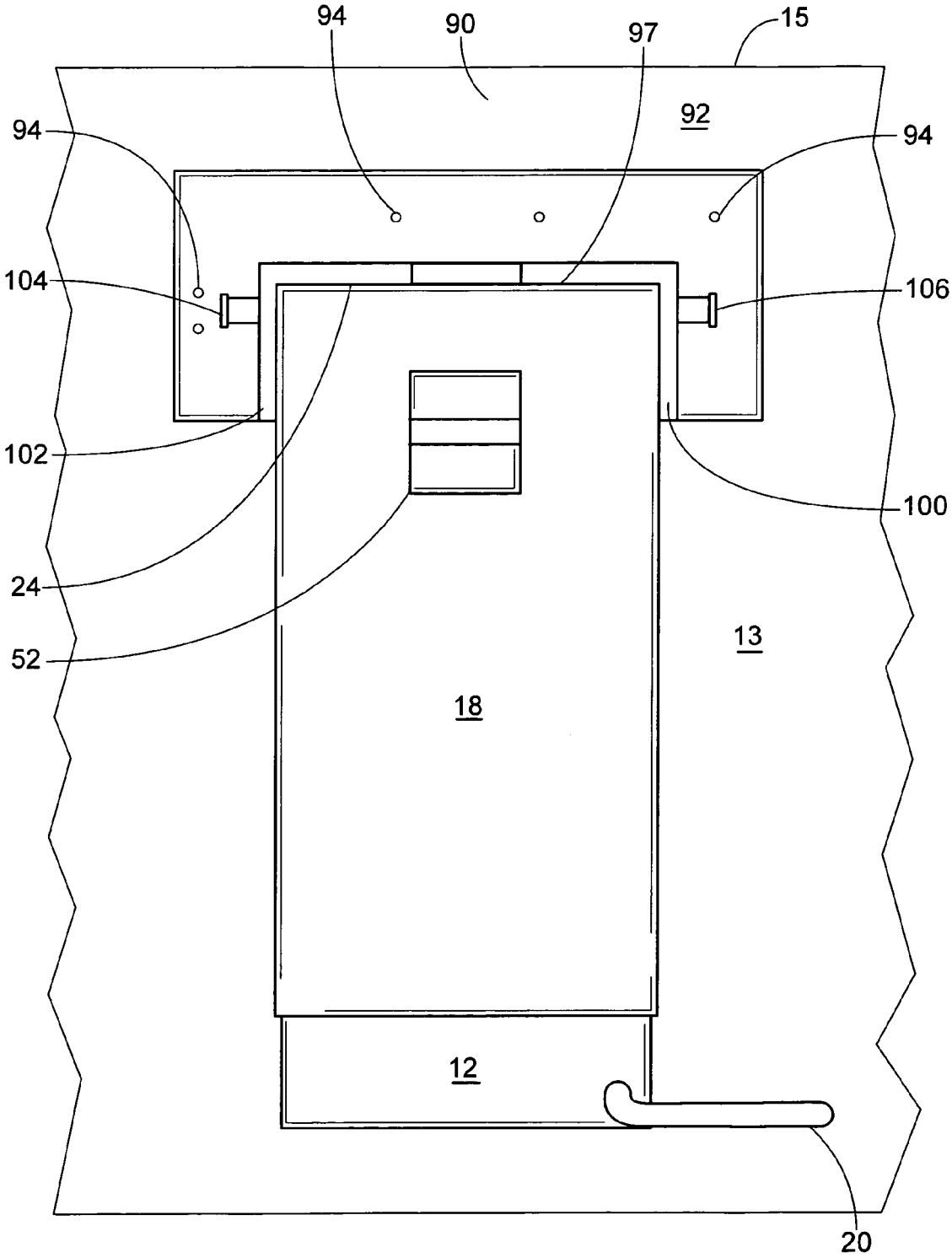
FIG. 8 is a rear view of the currency validator and depository cassette illustrating a second embodiment of installation.
Figure 9:
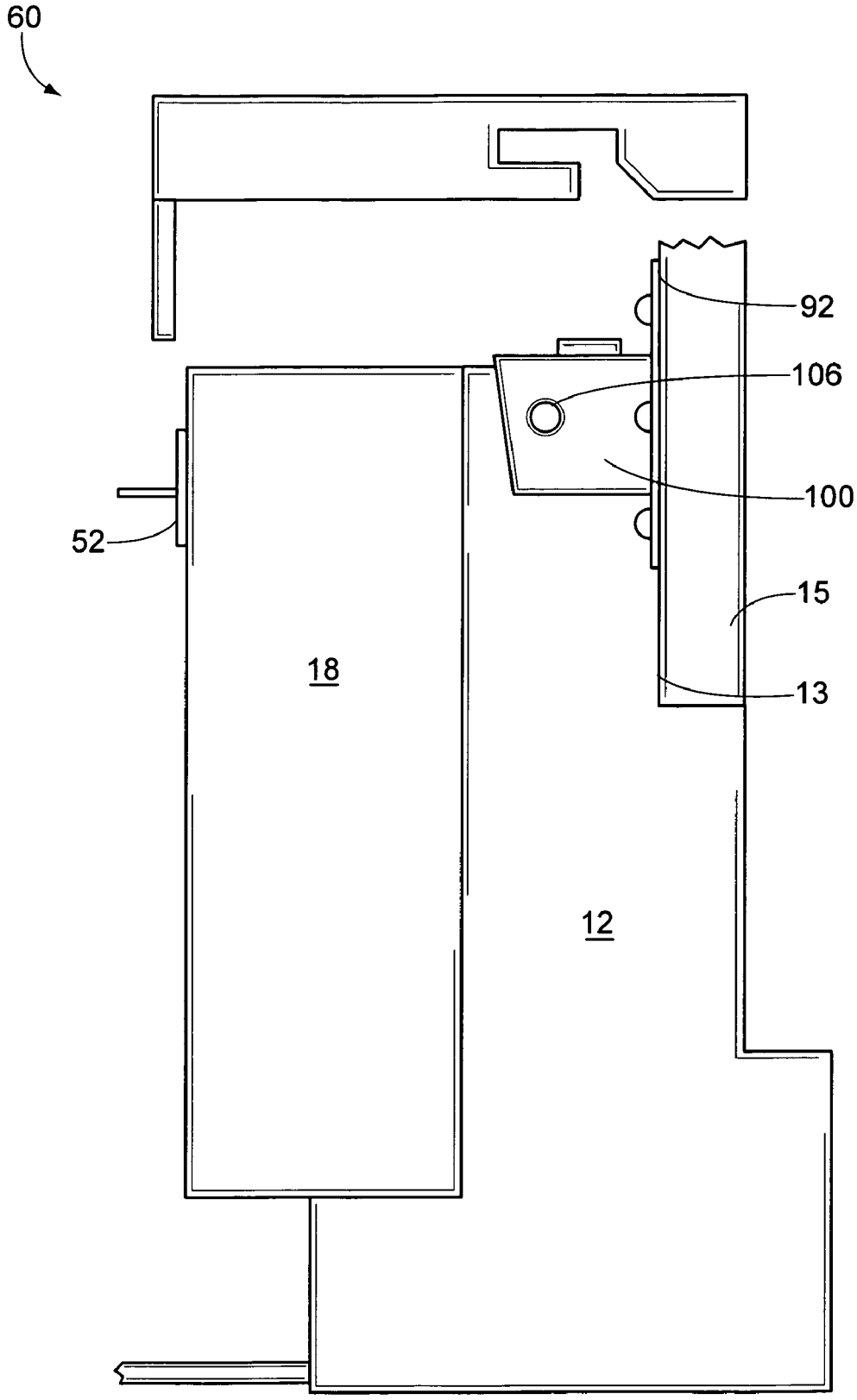
FIG. 9 is a side view of FIG. 8.
Figure 10:
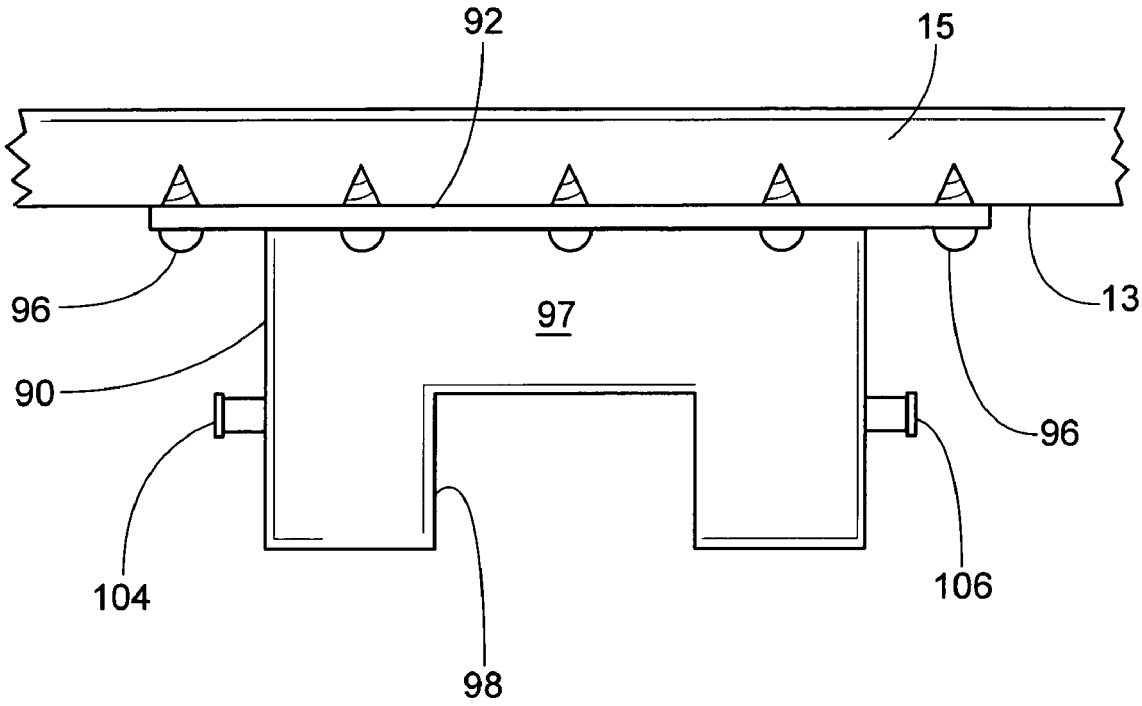
FIG. 10 is a top view of the bracket.

The locking security cover thus far described is suitable for a validating assembly and depository cassette as an original piece of equipment manufacture wherein the studs 44 and the shackle 51 would be secured or unitarily formed on the particular apparatus at the time of manufacture. There are however millions of vending machines in operation which include the currency validator and depository cassette without the modifications heretofore described. Applicant's locking security cover can be adapted to these in use currency validators and depository cassettes by means of an additional bracket which allows the locking security cover to function in the manner previously described. FIG. 8 is a rear view of the currency validator and depository cassette secured to the rear face of a vending machine illustrating the positioning of Applicant's bracket, FIG. 9 is a side view of the currency validator and depository cassette illustrating Applicant's bracket and locking security cover, and FIG. 10 is a top view of the bracket.

The currency validator 12 and depository cassette 18 are arranged in the same manner as previously illustrated on the inside face 13 of a vending machine wall 15 with the currency receiver 16 extending through the wall of the vending machine. The currency validator is in communication with a power source 20 and the currency validator and depository cassette would operate as previously disclosed. In this instance as an aftermarket add on item, there would be no aligned studs 44 extending outwardly from both sides of the currency validator to allow engagement with the locking security cover. Therefore in the aftermarket, a bracket 90 would be secured to the inside face 13 of the vending machine alignable with the currency validator 12 and depository cassette 18. As illustrated in FIG. 8, the bracket consists of a generally planar vertical wall portion 92 having a plurality of apertures 94 there through for the receipt of threaded fasteners 96 to secure the bracket 90 to the inside face 13 of the wall 15 of the vending machine. The vertical wall portion 92 of the bracket 90 is generally U-shaped and dimensioned to accommodate the width of the currency validator. Extending outwardly from vertical wall portion 92 and away from the rear face 13 of the vending machine would be a horizontal planar face 97 having a U-shaped cutout 98 formed therein so as to engage the upper surface 24 of the currency validator 12 and accommodate the release button 22 which normally allows separation of the currency validator 12 and the depository cassette 18.

Horizontal planar surface 96 has depending side walls 100 and 102 which abut the side walls 46 and 48 of the currency validator 12. Formed on these depending side walls are a pair of aligned outwardly extending studs 104 and 106. Bracket 90 therefore embraces a portion of the upper surface 24 of the currency validator 12 and a portion of the side surfaces 46 and 48. A shackle 52 would be secured to the rear face 54 of the depository cassette 18 in the same manner as previously illustrated. The locking security cover 60 as described and illustrated in FIGS. 4 and 5 can then be slidably secured over the depository cassette 18 and currency validator 12 with the inverted L-shaped slots 74 of the locking security cover 60 engaging the outwardly extending studs 104 and 106 on the side walls 46 and 48 of bracket 90. The rear wall 72 of the locking security cover 60 would have a slot formed therein for engagement with the shackle 52 on the rear face of the depository cassette 18. Once the locking security cover is secured to shackle 52 and the outwardly extending studs 104 and 106, a padlock 80 or other suitable locking means can be secured through shackle 52 so as to secure the currency validator and the depository cassette from unauthorized access.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof.

I claim:

1. An improved currency validator and depository cassette of the type used in vending and gaming machines, wherein said currency validator and depository cassette are in snap fit contact with each other with continuous top and side walls, and are secured to the interior face of a wall of a vending machine, said currency validatory having an extended currency slot for the receipt of paper currency, said currency validator further including a validation means and transport means to transport said paper currency and deposit said paper currency in said depository cassette, said depository cassette in said snap fit relationship with said currency validator and releasable from said snap fit relationship by means of a recess release button on an upper surface of said currency validator, the improvement comprising:

a security cover and locking means for prevention of the unauthorized separation of said currency validator and said depository cassette, said security cover and locking means comprising:

a shackle secured to the rear face of said depository cassette;

a bracket member secured to said rear face of said wall of said vending machine, said bracket comprising a horizontal wall portion having a plurality of apertures there through for the receipt of securing means to secure said bracket to said rear face of said wall of said vending machine, said bracket having a U-shaped cutout in said wall compatible with a width of said currency validator, there extending perpendicularly outwardly from said wall of said bracket, a horizontal surface having a U-shaped cut out for compatibility with said recess button on said currency validator, said horizontal surface having depending side surfaces such that said horizontal surface and said depending side surfaces abut a top surface and side walls of said currency validator, said side walls of said bracket having formed therein a pair of outwardly extending locking posts;

said security cover comprising a top wall, and end wall, and opposing side walls, said end wall extending downwardly and having a slot therethrough cooperable with said shackle on said depository cassette for receipt of a locking means, said opposing side walls each having an inverted L-shaped slot formed therein, cooperable with said outwardly extending locking posts disposed on opposing sides of said bracket for slidable locking engagement of said security cover over the top of said currency validator and said depository cassette, and secured in position by said locking means on said shackle to prevent the unauthorized separation of said currency validator and said depository cassette.

2. An improved currency validator and depository cassette of the type used in vending and gaming machines in accordance with claim 1 wherein the said shackle is integrally formed on said depository cassette.

3. The improved currency validator and depository cassette in accordance with claim 1 wherein said shackle is mechanically secured to said depository cassette.

* * * * *